United States Patent [19]

Armor et al.

[11] Patent Number: 4,615,736

[45] Date of Patent: Oct. 7, 1986

[54] PREPARATION OF METAL POWDERS

[75] Inventors: John N. Armor, Hanover Township, Morris County; Emery J. Carlson, Chatham, both of N.J.

[73] Assignee: Allied Corporation, Morris Township, Morris County, N.J.

[21] Appl. No.: 729,728

[22] Filed: May 1, 1985

[51] Int. Cl.[4] ..... B22F 1/00

[52] U.S. Cl. ..... 75/251; 75/0.5 A; 75/89; 75/97 A; 75/117; 75/118 R; 75/121; 75/252; 148/13; 148/13.1; 148/13.2; 148/20.6; 148/126.1; 419/2; 419/23; 419/32; 419/34; 419/62; 420/469; 420/590

[58] Field of Search ..... 419/2, 23, 32, 34, 62; 75/0.5 A, 89, 97 A, 117, 118 R, 121, 251, 252; 148/13, 13.1, 13.2, 20.6, 126.1; 420/469, 590

[56] References Cited

U.S. PATENT DOCUMENTS

| | | | |
|---|---|---|---|
| 2,825,108 | 3/1958 | Pond | 22/200.1 |
| 3,325,277 | 6/1967 | Huseby | 75/0.5 |
| 3,577,226 | 5/1971 | Elbert et al. | 419/2 |
| 3,598,567 | 8/1971 | Grant | 75/0.5 |
| 3,646,177 | 2/1972 | Thompson et al. | 264/12 |
| 3,661,571 | 5/1972 | Hinterman et al. | 419/2 |
| 3,764,295 | 10/1973 | Lindskog et al. | 75/0.5 |
| 3,813,196 | 5/1974 | Backstrom et al. | 425/7 |
| 4,469,816 | 9/1984 | Armor et al. | 502/333 |

FOREIGN PATENT DOCUMENTS 2555131 5/1977 Fed. Rep. of Germany

OTHER PUBLICATIONS

Murarka, Refractory Silicides for VSLI Production, Academic Press, 1983, pp. 115–131.

Danforth et al., "Synthesis of Ceramic Powders by Laser Driven Reactions", Industrial Liason Program No. 10-17-82, ILP Publications Office, MIT, Cambridge, MA.

S. J. Teichner et al., "Inorganic Oxide Aerogels", *Advanced in Colloid and Interface Science,* vol. 5, 1976, pp. 245–273.

*Primary Examiner*—Stephen J. Lechert, Jr.

*Attorney, Agent, or Firm*—Gus T. Hampilos; Gerhard H. Fuchs

[57] ABSTRACT

A process is disclosed for the preparation of metallic products from metal salts admixed with solvent wherein at least one of the metal salt and the solvent is easily reducible. The admixture is heated under hypercritical conditions of temperature and pressure to produce metallic products and a hypercritical fluid. The hypercritical fluid is subsequently removed from the reaction zone and the metallic product is collected. The metallic product includes pure metals selected from the group of silver, gold, platinum, palladium, ruthenium, rhodium, mercury, arsenic, rhenium, tellurium, iridium, osmium, and copper, and alloys and mixtures thereof. The metallic product ordinarily exists as finely divided powders which may be highly porous.

8 Claims, 7 Drawing Figures

Cu Aerogel

PRIOR ART Cu Powder

PREPARATION OF METAL POWDERS

BACKGROUND OF THE INVENTION

This invention relates to the preparation of metallic materials, which may be finely divided and highly porous, from easily reducible salts or from metal salts admixed with a reducing solvent.

In many applications, such as specialty metal strip mill powder rolling processes, metallic coatings, catalysts, conductive inks, and in the production of printed circuit boards, it is desirable to use finely divided metal powders. Moreover, it is highly desirable that the particles have a size and morphology which encourage intimate metal bonding.

Many methods for obtaining metals in powder form are known. Among the known methods, processes involving atomization of molten metal and mechanical grinding or milling predominate. Atomization processes, including variations on the basic concept, are disclosed, for example, in U.S. Pat. Nos. 3,325,277, 3,598,567, 3,646,177, 3,764,295, and 3,813,196. An example of the process employing milling or grinding is disclosed in German No. 2,555,131.

Additionally, the physical properties of powders have been manipulated by employing different known processes. For example, powders are produced in the form of agglomerates of solid particles, spherical particles and flakes. See U.S. Pat. Nos. 2,825,108, 3,813,196, and 3,325,277, and German No. 2,555,131.

Recently, a number of more exotic methods such as plasma processes and laser-assisted processes have been reported for producing ultra-fine metallic, nonmetallic and ceramic powders. See, for example, Murarka, *Refractory Silicides for VSLI Production,* Academic Press, 1983, pp. 115–31, and Danforth et al., "Synthesis of Ceramic Powders by Laser Driven Reactions," *Industrial Liaison Program Report No.* 10-17-82, ILP Publications Office, M.I.T., Cambridge, Mass. Furthermore, a unique class of very fine and porous ceramic materials has been prepared by a process which requires removal of solvent from a wet gel containing a ceramic powder product at a temperature above the critical temperature of the solvent. This unique class of materials has been given the name "aerogel."

Aerogels are usually produced by dissolving or suspending a metal ion (generally referred to as solute) usually in the form of a metal salt (such as an hydroxide, alkoxide or acetate) in an aqueous or alcohol medium (or both), and venting the solvent under hypercritical conditions. The medium functions to hydrolyze the metal salt to produce a gel comprising the ceramic product and solvent. Upon removal of the solvent as indicated above, a porous, very fine ceramic product can be recovered. A detailed description of this method is reported by S. J. Teichner et al, "Inorganic Oxide Aerogels", *Advances in Colloid and Interface Science,* Volume 5, 1976, pp. 245–73.

SUMMARY OF THE INVENTION

Surprisingly, we have discovered that highly porous, fine metallic powders can be synthesized by a process which comprises the steps of:

(a) admixing a metal salt of a metallic material selected from the group consisting of silver, gold, platinum, palladium, ruthenium, rhodium, mercury, arsenic, rhenium, tellurium, iridium, osmium, and copper and mixtures thereof and an organic solvent;

(b) heating the admixture to hypercritical conditions to convert the admixture to a fluid phase and a metallic material;

(c) venting the fluid phase under hypercritical conditions to yield a metallic product; and (d) collecting the metallic product.

Most preferably, the salt of the metallic material and the organic solvent react under hypercritical conditions to produce a fluid phase comprising at least one of formic acid, methyl formate and formaldehyde. The more preferred organic solvents are selected from $C_1$–$C_5$ alcohols, with methanol being most preferred.

DETAILED DESCRIPTION

Figure 2A:
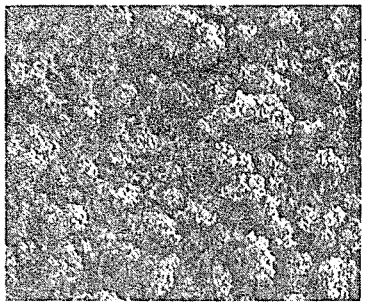
FIGS. 2*a*, 2*b*, and 2*c* are photographs of copper aerogels produced in accordance with our process at magnifications of 100x, 1000x, and 21000x.

The finely divided, porous metallic powders (as pure metals, metal alloys, or mixtures thereof) are produced from metal salt. The term metal salt as used herein includes simple metal salts, complex metal salts, and mixtures thereof. Metal salt is salt of metal selected from the group of gold, copper, silver, platinum, palladium, ruthenium, rhodium, mercury, arsenic, rhenium, tellurium, iridium, osmium, and mixtures thereof. Useful metal salts include any metal salt (hydrated or anhydrous) which can be solubilized by or dispersed in an organic solvent at a temperature less than or equal to about the processing temperature employed to generate a metallic powder product and a hypercritical fluid. For example, useful salts include metal oxides, metal halides, metal sulfates, metal nitrates, metal formates, metal alkoxides, metal acetyl acetonates, metal acetates, and mixtures thereof. Preferably, the salt is an easily reducible salt selected from the group comprising metal alkoxides, metal acetyl acetonates, metal acetates, and metal formates. Generally, an easily reducible salt is a salt which, when reacted with the solvent under hypercritical conditions, will yield a reducing agent having an E° (as measured in acid solutions at approximately 25° C.) greater than the E° of the metallic ion to metal couple. Most preferably, the metal salt is selected from the group of metal formates and metal acetates.

To the metal salt is added an organic solvent. The organic solvent must be selected such that it will dissolve at least some of the salt, or will disperse the salt to produce a generally uniform dispersion. The organic solvent may also react with the salt to cause the precipitation of, for example, metallic oxides and/or hydroxides which remain suspended in solution prior to heating under hypercritical conditions. Suitable organic solvents include hydrocarbons, ketones, alaphatic or aromatic hydrocarbons (e.g., benzene or toluene), kerosene, glycols (especially $C_2$- or $C_3$-glycols), ethers, alcohols, or mixtures thereof. Preferably, the organic solvent is a reducing agent. That is to say that a reducing agent, as defined herein, is a constituent of the reaction of the metal salt and the organic solvent which has an E° (as measured in acid solutions at approximately 25°

C.) greater than the E° of the metallic ion to metal couple. More preferably, the less easily reducible the metal salt, the greater the requirement for the organic solvent to be a reducing agent. Most preferably, the solvent and salt should react to produce a known reducing agent of a reducing capacity approximately equal to the reducing capacity of formaldehyde, methyl formate or formic acid prior to venting of the hypercritical fluid phase. Obviously, the preferred reaction is one in which formaldehyde and/or formic acid would be produced for a time sufficient to reduce the metallic ion. Therefore, the more preferred solvents are selected from the group of $C_1$–$C_5$ alcohols, with methanol being the most preferred organic solvent.

Water may be present in the system; for example, water may be present in an amount sufficient to at least partially hydrolyze the salt, such as a stoichiometric amount. However, the presence of water is not critical to the process. In fact, the process has been carried out under substantially anhydrous conditions. Nevertheless, the amount of water present in the system should not exceed more than about 200% of the stoichiometric amount.

The admixture (in the form of a solution, suspension, or gel) is supplied to a chamber (either by batches or continuously fed), for example, an autoclave, wherein it is heated under pressure to hypercritical conditions. A typical apparatus can be of the type disclosed in application Ser. No. 656,820, filed Oct. 1, 1984, to the same inventors and commonly assigned. Hypercritical conditions exist at or above the temperature and pressure necessary to convert the liquid phase of the admixture to a fluid phase. The specific temperature and pressure at which the liquid to fluid conversion takes place depends upon the particular composition of the liquid phase. Such conditions are generally well known to those of ordinary skill in the art or can be calculated by those of ordinary skill in the art according to the procedures described in Reid et al, *Properties of Liquid and Gases,* Chapters 5–7. For example, the critical temperature and pressure for methanol is about 240° C. and 79 atm, respectively, and for n-butanol is about 287° C. and about 48 atm, respectively. Most preferably, the temperature is maintained at about 25° C. higher than the critical temperature of the liquid phase in order to insure substantially complete reduction of the metal salt(s).

Normally, the admixture is held under hypercritical conditions for a period of time ranging from about five minutes to about two hours prior to venting of the fluid phase. The time period is not critical to the process; subjecting the admixture to hypercritical conditions is critical. Thereafter, the fluid phase is vented from the chamber while under hypercritical conditions, and the metallic product remains in the chamber to be collected.

The metallic product can be pure metal, an alloy, a mixture or any permutation thereof comprising at least one of Ag, Au, Pt, Pd, Ru, Rh, Os, Re, As, Te, Ir and Cu. Typically, the powder product exists as generally spherical particles of less than or equal to about 1 μm in diameter, which may combine to produce porous products ranging from about 5 to about 25 μm in their largest dimension.

Figure 1A:
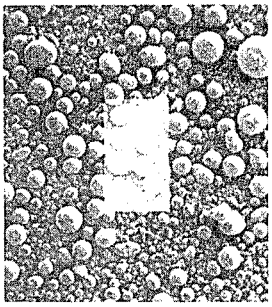
FIGS. 1*a*, 1*b*, and 1*c* are photographs of commercially available copper powder at magnifications of 100x, 1000x, and 20000x, respectively.
Figure 2B:
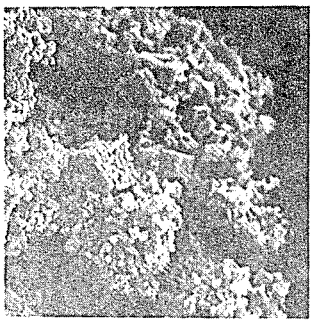
Figure 1B:
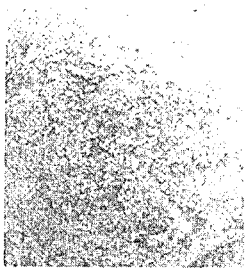
Figure 2C:
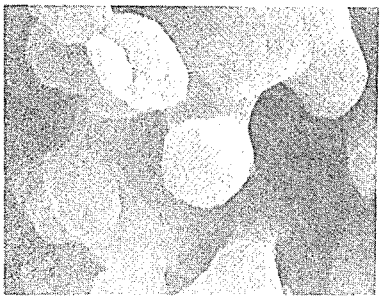
Figure 1C:
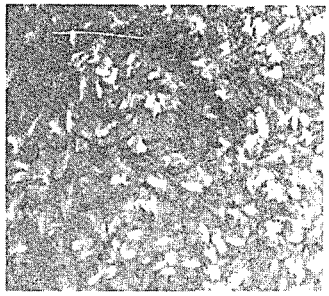

SEM photographs of a copper aerogel were quite startling when compared to commercially available copper powder. FIGS. 1*a*, 1*b*, and 1*c* illustrate the morphology of a commercial copper powder (B&A grade, #1618). FIGS. 2*a*, 2*b*, and 2*c* illustrate the morphology of a copper product produced in accordance with our process. At all levels of magnification (100x, 1000x, and ≈20000x) dramatic differences are observed with evidence of considerable sintering having occurred (at the 1 micron level). The aerogel product is extremely porous with 1 micron "knob-like" projections giving the product the appearance of coral. Commercial copper powders are quite coarse and non-porous with even the best electrolytic powder being on the order of 5–20 microns.

Figure 3:
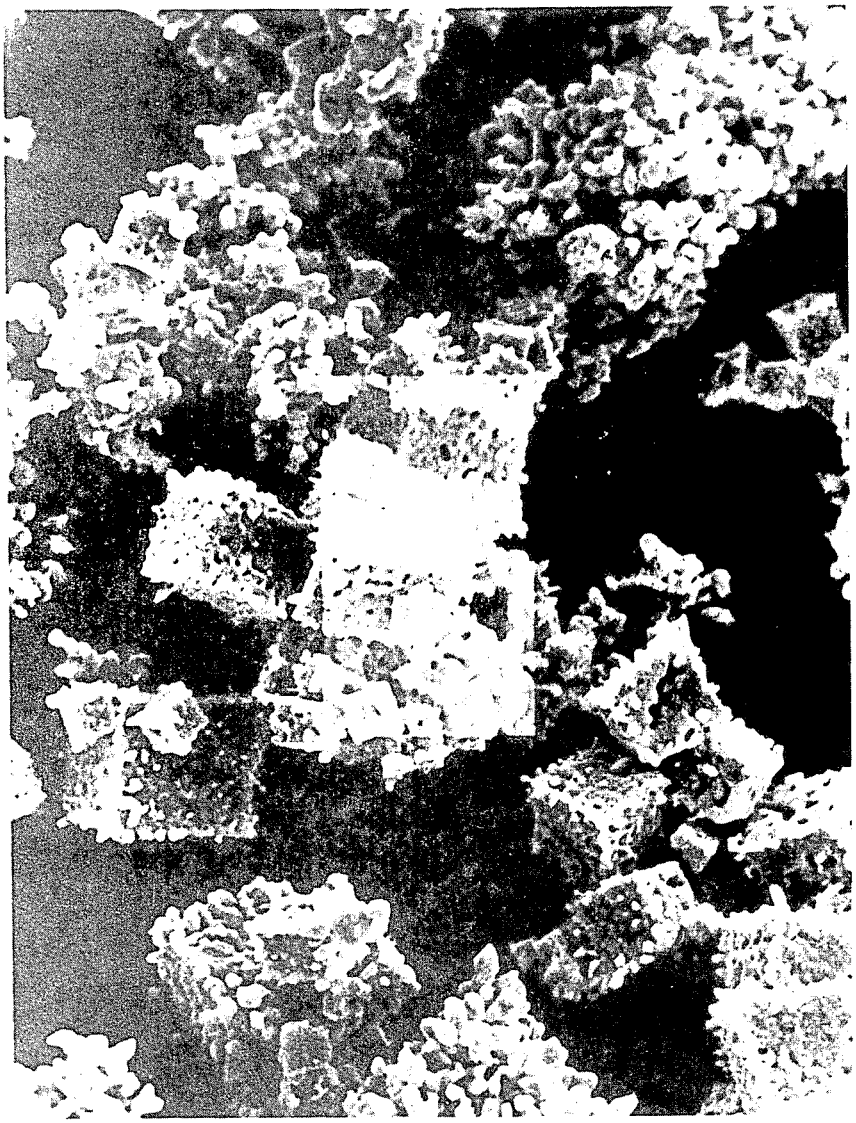
FIG. 3 is an enlargement of the copper aerogel pictured in FIG. 2*b*.

Upon closer examination of the 10 micron level micrograph, one can observe distinct cubes. FIG. 3 represents an enlargement of the 10 micron micrograph. Here one can see a random clustering of apparently perfect cubes with edges of 3–10 microns. It is apparent that these cubes are extremely porous. Further, 1 micron spheres seem to preferentially build upon the edges of each cube.

The following examples illustrate specific embodiments of applicants' basic process for the production of metallic powdered products. The examples are not to be construed as limiting the invention defined by the appended claims, and various modifications, alterations, and changes to the procedures outlined herein may be made by those of ordinary skill in the art.

EXAMPLE 1

Copper aerogel was produced in accordance with the following procedure. A solution of 120 cc of reagent grade methanol and 12 cc of distilled water as preheated to 55° C. in a test tube (300 cc) which served as the liner for the autoclave. Cupric acetate (7.8 g of $Cu(OAc)_2 \cdot H_2O$) was added with stirring to yield a deep green solution which (at 60° C.) slowly yielded (30 min.) a sponge-like, turquoise solid. The glass liner was inserted into a 300 cc Aminco autoclave, purged with $N_2$ via pressure pulses, and heated well above the estimated critical temperature of the mixture to about 275° C. The maximum pressure of 2120 psi was maintained for about 1 hour and then the fluid was vented (while remaining above the critical temperature) continously over the next hour. The autoclave was purged with $N_2$ by successive pressure pulses. The glass liner was removed under a continuous flow of $N_2$, and the solid transferred under $N_2$ (in a glove bag). (While the latter two steps are not necessary, they were added to avoid possible contamination of the product prior to the surface science studies that were later conducted on the brick-red product.) Material balance calculations indicated that the product was consistent with metallic copper. Under the reaction conditions, the combination of methanol and heat served to reduce the copper salts to finely-divided metallic copper. The brick-red powdery material was analyzed by a number of techniques. X-ray powder diffraction indicated it was primarily crystalline, metallic copper. However, ESCA analysis of commercial copper dust usually shows the presence of trace surface coatings of copper(II) oxide with a small amount of copper(I), but the aerogel product was characterized by more copper(I) and copper(0) surface oxidation states. Single point BET analysis of the copper aerogel indicated a surface area of 0.23 $m^2/g$.

EXAMPLE 2

Copper aerogels were produced from copper(II) and copper(I) acetate (both as the monohydrate and as the anhydrous salt). Methanol and isopropanol were used as solvents. The use of isopropanol was less desirable because, as with anhydrous copper acetate, the precipitate appeared to settle rapidly. Notwithstanding the relative desirability of the solvent and the salt, the systems were exposed to conditions both above and below the estimated critical temperature (approximately 245°–250° C.). At less than about 240° C., the characteristic brick-red, finely-divided product was not produced from any of the systems. Working with the systems at about 255° C. and also at about 280° C. yielded the metallic copper product.

EXAMPLE 3

The production of a mixture of pure powders and alloys was accomplished under the following procedure. 1 g of $Pd(OAc)_2$ was added to a solution of copper(II) acetate in methanol produced in accordance with the procedure in Example 1. A gray-black precipitate was produced. ESCA analysis indicated that the precipitate was a mixture of Pd, Cu, and a face centered cubic Cu-Pd alloy.

EXAMPLE 4

Gold powder was produced in accordance with the following process. 1.6 g of gold(I) acetate (ICN Pharmaceuticals) was added to 80 cc of methanol and 2 cc of water in a 300 cc test tube (preheated to 65° C.). After about 30 min. at 65° C., the solution yielded a brown solid. The suspension was inserted into a 300 cc Aminco autoclave, purged with $N_2$ via pressure pulses and heated well above the estimated critical temperature of the mixture to about 282° C. A pressure of 2010 psi was maintained for $\approx$2 hours and then venting (while remaining above the critical temperature) was initiated and continued over about the next 60 min. The product produced by this process was analyzed and the analysis indicated the production of pure gold powder.

EXAMPLE 5

Attempts to reduce vanadium, chromium, iron, and tin salts employing the basic concepts of the invention did not yield the elemental forms of the materials.

EXAMPLE 6

A fine suspension of $V_2O_5$ in aqueous methanol was subjected to hypercritical conditions and hypercritical venting of the resulting fluid phase. The surface area (BET) of the bulky jet-black product was 96.7 $m^2/g$, and pore volume was 1.06 cc/g. However, x-ray analysis proved that the material was not vanadium metal.

We claim:

1. A method of producing metallic powders comprising the steps of:

(a) admixing a metal salt of a metallic material selected from the group consisting of silver, gold, platinum, palladium, ruthenium, rhodium, mercury, rhenium, arsenic, tellurium, iridium, osmium, copper, and mixtures thereof and an organic solvent;

(b) placing the admixture in a container and applying heat and pressure sufficient to convert the admixture to a fluid phase and a metallic product;

(c) segregating the fluid phase from the metallic product; and (d) collecting the metallic product.

2. The process of claim 1 wherein the solvent is an organic solvent selected from the group consisting of $C_1$–$C_5$ alcohols.

3. The process of claim 1 wherein the metallic product comprises a metal or an alloy selected from the group consisting copper, gold, silver, platinum, palladium, rhodium, ruthenium, osmium, mercury, rhenium, arsenic, tellurium, iridium, and mixtures thereof.

4. The process of claim 3 wherein the solvent is methanol.

5. The process of claim 1 wherein the temperature is maintained at least about 25° C. above the critical temperature of the solvent.

6. The process of claim 1 wherein the fluid phase comprises at least one of formic acid, formaldehyde and methyl formate.

7. The process of claim 4 wherein the metal salt is a copper salt.

8. A metallic product selected from the group of copper and copper alloys comprising porous cubic agglomerates comprised of generally spherical particles of about 1 $\mu$m in diameter.

* * * * *